US005927135A

United States Patent [19]

Kutschker

[11] Patent Number: 5,927,135

[45] Date of Patent: Jul. 27, 1999

[54] BENDING MACHINE

[75] Inventor: Wolfgang Kutschker, Boeblingen, Germany

[73] Assignee: Reinhardt Maschinenbau GmbH, Sindelfingen, Germany

[21] Appl. No.: 09/083,685

[22] Filed: May 22, 1998

Related U.S. Application Data

[63] Continuation of application No. PCT/EP97/04797, Sep. 4, 1997.

[30] Foreign Application Priority Data

Sep. 28, 1996 [DE] Germany ..... 196 40 124

[51] Int. Cl.[6] ..... B21D 5/04

[52] U.S. Cl. ..... 72/319

[58] Field of Search ..... 72/319–323

[56] References Cited

U.S. PATENT DOCUMENTS

| | | | |
|---|---|---|---|
| 134,376 | 12/1872 | Gorton | 72/321 |
| 1,806,986 | 5/1931 | Rucker . | |
| 4,112,731 | 9/1978 | Anderson | 72/320 |
| 5,630,336 | 5/1997 | Jorgenson | 72/319 |

FOREIGN PATENT DOCUMENTS

| | | | |
|---|---|---|---|
| 452606 | 11/1948 | Canada | 72/320 |
| 0 105 091 | 4/1984 | European Pat. Off. . | |
| 86 00 539 | 7/1986 | Germany . | |
| 93 07 907 | 9/1993 | Germany . | |
| 1 548 707 | 7/1979 | United Kingdom . | |
| 92/00154 | 1/1992 | WIPO . | |

*Primary Examiner*—Daniel C. Crane
*Attorney, Agent, or Firm*—Barry R. Lipsitz; Ralph F. Hoppin

[57] ABSTRACT

In order to improve a bending machine comprising a lower beam with a lower beam tool, an upper beam with an upper beam tool, wherein the upper beam tool and the lower beam tool are movable relative to one another for clamping a workpiece, as well as a bending beam pivotable about a pivot axis and having bending beam tool segments arranged on it, each of which has a pressure surface segment, wherein a bending beam pressure surface acting on the workpiece during bending can be made up of the pressure surface segments, such that it is possible to vary a width of the bending beam pressure surface in a simple manner it is suggested that at least one bending beam tool segment be designed to be adjustable and that the pressure surface segment of the adjustable bending beam tool segment be movable from an active position, in which it contributes to the pressure surface of the bending beam tool, into an inactive position, in which it is without effect during a bending operation.

18 Claims, 8 Drawing Sheets

14
24
154
150
162
166
60
64
58
160
164
146
82
80
92
30
54
50
66
144

12
22
30
40
60
64
66
68
72
80
118
146
160
164

BENDING MACHINE

This application is a continuation of International PCT Application No. PCT/EP97/04797 filed on Sep. 4, 1997.

BACKGROUND OF THE INVENTION

The invention relates to a bending machine comprising a lower beam with a lower beam tool, an upper beam with an upper beam tool, wherein the upper beam tool and the lower beam tool are movable relative to one another for clamping a workpiece, as well as a bending beam pivotable about a pivot axis and having bending beam tool segments arranged on it, each of which has a pressure surface segment, wherein a bending beam pressure surface acting on the workpiece during bending can be made up of the pressure surface segments.

Bending machines of this type are known from the state of the art. With these, a width of the bending beam pressure surface is adapted to a respective workpiece to be bent each time prior to the bending of the workpiece in that a corresponding number of bending beam tool segments are placed on the bending beam. If it is necessary to alter the width of the bending beam pressure surface during the course of the bending of a workpiece, at least one bending beam tool segment must always be shifted or removed.

SUMMARY OF THE INVENTION

The object underlying the invention is therefore to improve a bending machine of the generic type such that it is possible to vary a width of the bending beam pressure surface in a simple manner.

This object is accomplished in accordance with the invention, in a bending machine of the type described at the outset, in that at least one bending beam tool segment is designed to be adjustable and that the pressure surface segment of the adjustable bending beam tool segment is movable from an active position, in which it contributes to the bending beam pressure surface, into an inactive position, in which it is without effect during a bending operation.

The advantage of the inventive solution is thus to be seen in the fact that as a result of the adjustable bending beam tool segment the shifting or removal of a bending beam tool segment as a whole is superfluous since the adjustable bending beam tool segment always remains in the same position on the bending beam during the bending of a workpiece by means of the required bending operations, and thus a varying use of the adjustable bending beam tool segment, particularly during the course of the machining of a workpiece, is possible in a simple manner since only a movement of the pressure surface segment between the active and the inactive position is required.

In this respect, all movement possibilities of the pressure surface segment are conceivable. A particularly favorable solution provides for the movable pressure surface segment to be arranged in the inactive position so as to be offset in the direction towards the bending beam in relation to the active position. This solution allows the pressure surface segment to be brought in a simple manner into an inactive position, in which an interaction with the workpiece during the course of the bending can be avoided.

In order to ensure that no collision of the bending beam tool segment in the inactive position occurs with a region of the workpiece located within a predetermined free space around the bending edge, it is preferably provided for all the regions of the bending beam tool segment passing through the workpiece plane in the inactive position during a bending procedure to be located outside a free space radius around the bending edge defining the free space.

The pressure surface segment can, in principle, be moved in various directions in order to transfer it from the active position into the inactive position. It is, for example, conceivable to move the pressure surface segment in bending direction in order to reach the inactive position.

A particularly advantageous solution provides for the movable pressure surface segment in the inactive position to be located in a bending start position on a side of a lower beam tool tip of the lower beam tool facing away from the upper beam tool. As a result, a slight pivoting movement of the pressure surface segment is already sufficient to transfer this from the active position into the inactive position.

With respect to the design of the bending beam tool segment, no details have been given in conjunction with the preceding explanations concerning the individual embodiments. One advantageous embodiment, for example, provides for the adjustable bending beam tool segment to have a base part and a pressure bar supported by this and bearing the movable pressure surface segment and for the pressure bar to be movable in relation to the base part. As a result of this design of the adjustable bending beam tool segment, a movement of the pressure surface segment between the active and the inactive position can be realized in a simple way.

In order to ensure in this case that the pressure bar bearing the movable pressure surface segment does not come into contact with the workpiece during the bending and thereby cause an undesired bend in the workpiece, it is preferably provided for the pressure bar, in the inactive position of the movable pressure surface segment, to move during the course of a bending operation free of contact in relation to a workpiece plane.

This contact-free movement of the pressure bar relative to the workpiece plane may be achieved particularly favorably by the pressure bar remaining on one side of the workpiece plane without touching it during the bending operation.

An expedient embodiment of an inventive solution provides for the pressure bar to be movable in a direction contrary to the bending pivot direction during the movement from the active into the inactive position so that the pressure bar is offset contrary to the bending pivot direction in the inactive position in relation to the active position and, thus, during the bending operation, i.e. a movement of the pressure bar in bending pivot direction, in relation to the active position also proceeds behind this.

A favorable geometry with respect to the positioning of the pressure bar in the inactive position may be achieved when the pressure bar is located in the bending end position on a side of the workpiece plane facing the bending start position.

Since the movable pressure surface segment is located in its active position directly next to a bending edge of the lower beam or upper beam tool, and an adjustment of the bending beam tool segment from the active into the inactive position could lead to a collision with, for example, the lower beam tool, it is preferably provided for the bending beam to be displaceable relative to its pivot axis in order to have adequate space for the movement of the movable pressure surface segment from the active into the inactive position and vice versa.

In this respect, the bending beam is preferably moved relative to its pivot axis such that the adjustable bending beam tool segment is remote from the bending edge defined by the upper beam tool or the lower beam tool and thus an interference-free movement of the movable pressure surface segment is possible.

In conjunction with the embodiments of the inventive solution explained thus far, it has merely been assumed that the pressure bar is movable back and forth between the active and the inactive position, wherein this can also be realized, for example, by means of a linear movement with a correspondingly designed guide means. A particularly expedient inventive solution does, however, provide for the pressure bar to be pivotable back and forth between the active and the inactive position. The pivotal design of the connection of the pressure bar with the base part has the advantage that the pressure bar is more stable on account of the constant connection via the pivot axis and can be secured in position in a simple manner.

The axis, about which pivoting occurs, preferably extends parallel to a bending edge.

It is particularly expedient when the pressure bar is pivotable in relation to the base part about an axis which is parallel to the movable pressure surface segment and is arranged on one side of a mid-vertical in relation to the movable pressure surface segment. If the pressure bar extends approximately parallel to the mid-vertical, the axis is also located on one side of the pressure bar. If pivoting from the active into the inactive position takes place in a direction pointing away from the axis, a lowering of the pressure surface segment in a direction towards the bending beam is also achieved with this solution in addition to the pivoting of the pressure bar.

The position of the axis is particularly favorable when this is located on a leading side of the pressure bar in the bending pivot direction since the movement of the pressure bar from the active into the inactive position can thus take place in a direction contrary to the bending pivot direction.

With respect to the securing in position of the pressure bar, especially in the active position, no details have so far been given. One particularly favorable solution, for example, provides for the pressure bar to be supportable in the active position by a support arm movable back and forth between a supporting position and a non-supporting position. This solution has the advantage that it is, on the one hand, simple to operate and, on the other hand, ensures a stable support of the pressure bar in the active position.

In this respect, it is particularly favorable when the support arm is mounted on a bearing member of the pressure bar so as to be pivotable and the bearing member of the pressure bar forms together with the support arm an elbow lever mechanism which supports the pressure bar in the active position in a stable manner.

In order to define the supporting and non-supporting position of the support arm it is preferably provided for the support arm to be guided with its free end in a slotted guide means determining the supporting and the non-supporting position. As a result, the supporting position of the support arm as well as the movement thereof from the supporting position to the non-supporting position and vice versa can be determined in a defined manner, in particular, via the slotted guide means.

With respect to the possibility of acting on the support arm in order to move this from the supporting into the non-supporting position, no details have so far been given. A particularly expedient solution, for example, provides for the support arm to be actuatable by a slide.

In this respect, it is preferably provided for the slide to act on the end of the support arm guided in the slotted guide means in order to move this along the slotted guide means.

In conjunction with the solution described thus far, no details have been given as to how any adjustment of the adjustable bending beam tool segment is intended to be carried out. It would, for example, be conceivable to adjust the bending beam tool segment manually.

However, in order to be able to move the bending beam tool back and forth as quickly and, with respect to time, as favorably as possible between the active position of the pressure surface segment and the inactive position of the pressure surface segment within a production program optimized with respect to time, a manipulator is preferably provided which can actuate the adjustable bending beam tool segment and can be controlled via a machine control of the bending machine. An adjustment of the adjustable bending beam tool segment can thus take place via the machine control directly and automatically.

In order, in the case of different adjustable bending beam tool segments, to be able to act on these individually, it is expediently provided for the manipulator to be displaceable parallel to the bending beam, namely such that it can reach each adjustable bending beam tool segment arranged on it.

In order to be able to carry out an adjustment of the bending beam tool segment, the manipulator is preferably provided with an actuating arm likewise controllable via the machine control and this arm interacts with the adjustable bending beam tool segment, for example, engages on it.

The actuating arm can engage on the adjustable bending beam tool segment in the most varied of ways. In the simplest case, it is provided for the actuating arm to interact with the slide of the adjustable bending beam tool in order to move the movable pressure surface segment from the inactive into the active position and vice versa.

Additional features and advantages of the invention are the subject matter of the following description as well as the drawings illustrating several embodiments.

DETAILED DESCRIPTION OF THE INVENTION

Figure 1:
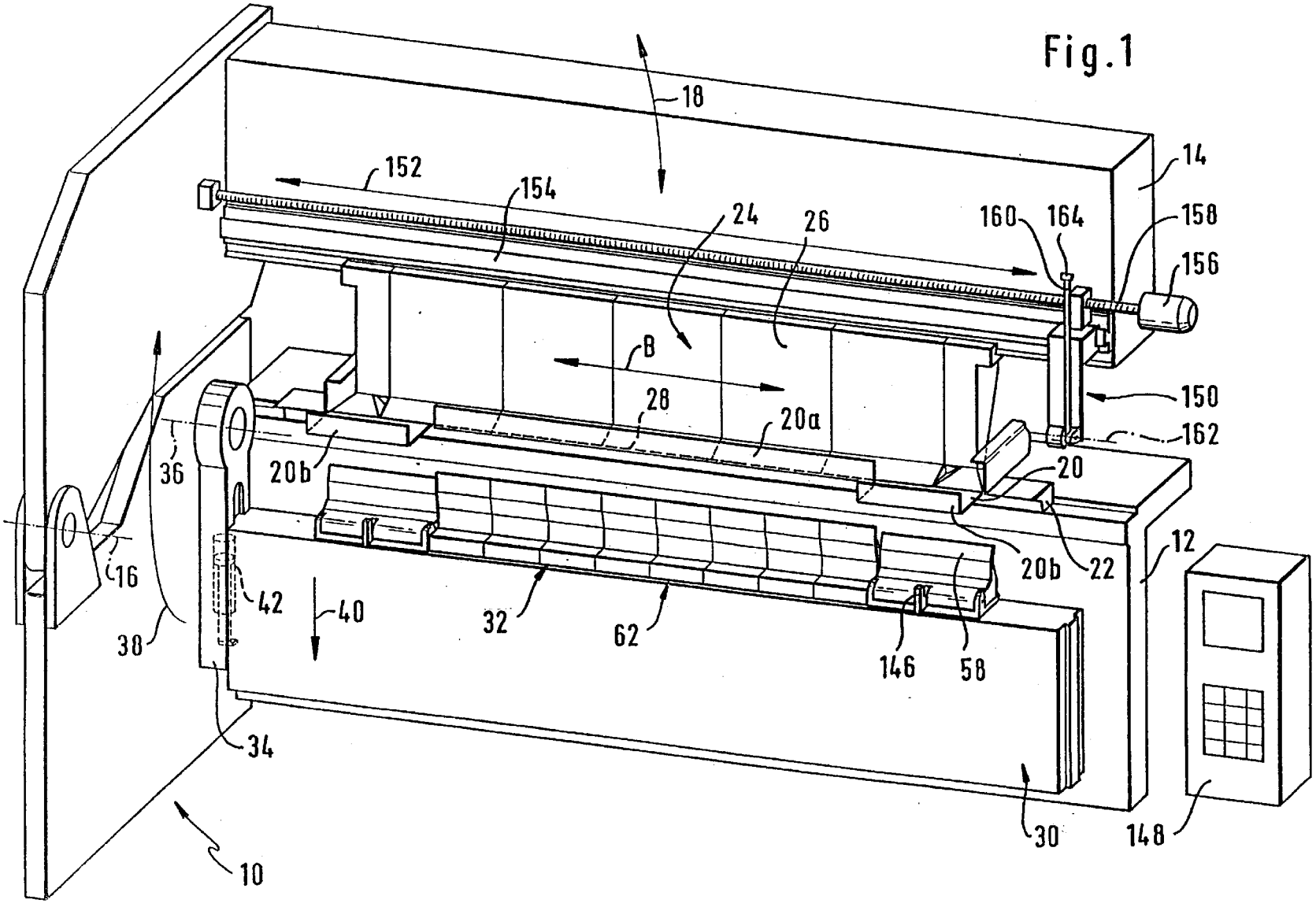
FIG. 1 shows a schematic perspective view of a first embodiment of an inventive bending machine with the right-hand part of a machine frame missing.

An embodiment of an inventive bending machine illustrated schematically in FIG. 1 comprises a machine frame 10, to which a lower beam 12 is securely connected. Furthermore, an upper beam 14 is mounted on the machine frame 10 for pivoting about a pivot axis 16 and can thereby be moved in a direction 18 towards the lower beam 12 or away from it in order to clamp a workpiece, for example, a sheet-metal part designated as a whole as 20 for the purpose of bending.

For the purpose of bending the workpiece 20, the lower beam 12 is provided with a lower beam tool 22 and the upper beam 14 with an upper beam tool 24 which is preferably constructed from a plurality of upper beam tool segments 26 in order to be able to configure the upper beam tool 24 in a flexible manner with respect to its width B.

Figure 2:
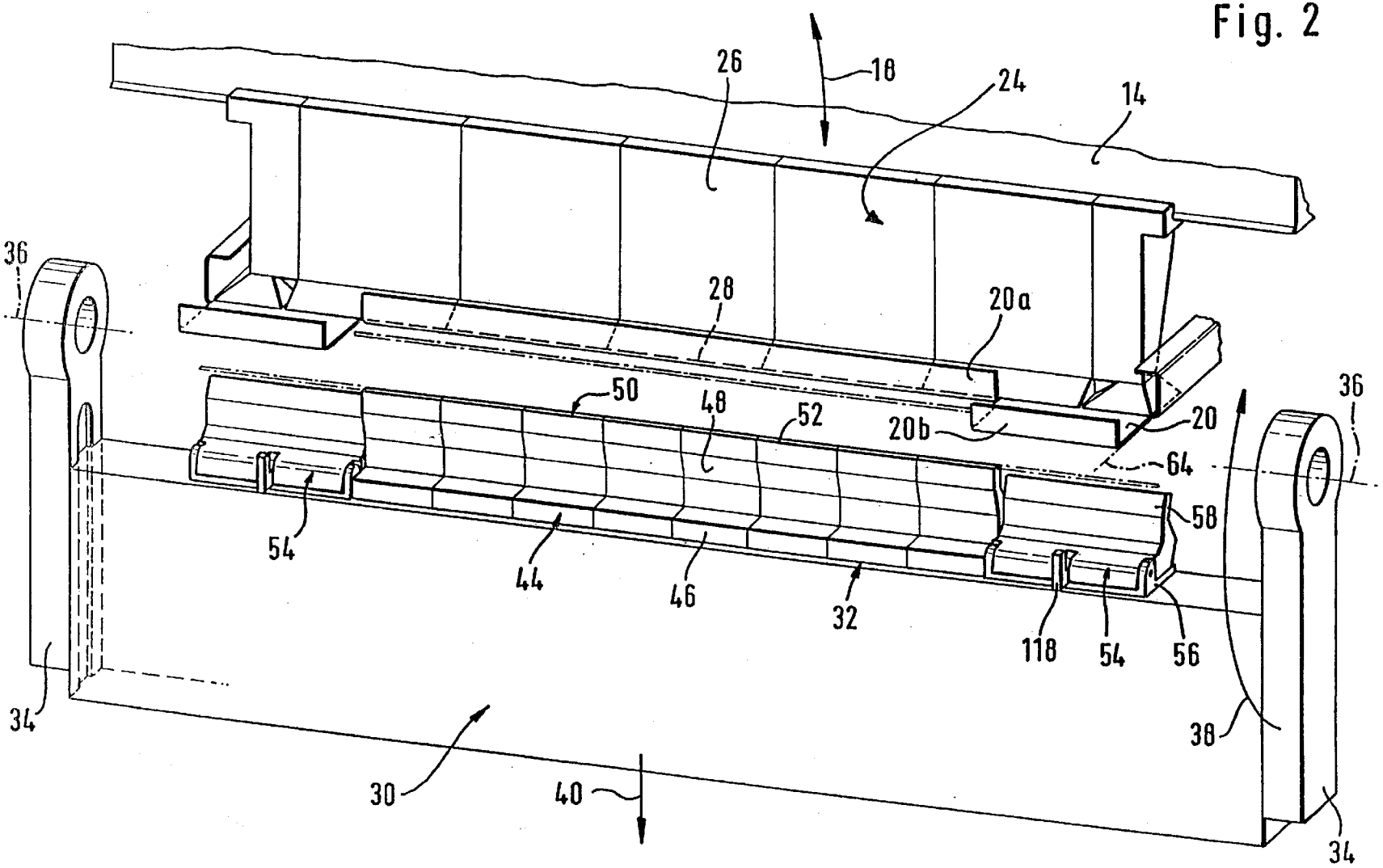
FIG. 2 shows an enlarged, detailed illustration of a bending beam with bending beam tool and an upper beam with upper beam tool and a workpiece of the first embodiment held on the upper beam tool by a lower beam tool illustrated as non-abutting.

For the purpose of bending the workpiece 20, this is, as illustrated in FIGS. 1 and 2, placed between the lower beam tool 22 and the upper beam tool 24 and clamped between the lower beam tool 22 and the upper beam tool 24 by movement of the upper beam tool 24 together with the upper beam 14 in a direction 18 towards the lower beam 12.

In order to now bend over an edge region of the workpiece 20 designated in FIGS. 1 and 2 as 20*a* along a bending line 28 drawn as a dashed line in FIGS. 1 and 2, a bending beam is provided which is designated as a whole as 30 and bears a bending beam tool designated as a whole as 32.

The bending beam 30 is, for its part, mounted on bending beam arms 34 arranged on opposite sides thereof, wherein the bending beam arms 34 are mounted on the machine frame 10 so as to be pivotable about a pivot axis 36. As a result, the entire bending beam 30 can be moved about the pivot axis 36 in a bending pivot direction 38, wherein this movement takes place as a result of a drive not illustrated in FIG. 1.

In addition, the bending beam 30 is not held rigidly on the bending beam arms 34 but movable linearly in a direction 40, wherein the direction 40 extends approximately parallel to the longitudinal direction of the bending beam arms 34 and parallel to a radial direction relative to the pivot axis 36. As a result, the entire bending beam 30 is adjustable in its bending start position illustrated in FIG. 1 relative to the workpiece 20 clamped between the lower beam tool 22 and the upper beam tool 24. The adjustment is preferably made via an adjusting drive 42 arranged in the bending beam arms 34, which is, in the simplest case, designed as a cylinder and with which the bending beam 30 can be moved relative to the bending beam arms 34 between an upper position and a lower position.

In order to be able to adapt the bending beam tool 32 to different widths B of the workpiece 20, in particular, to the edge region 20*a* located between edge regions 20*b* and set back in relation to them, the bending beam tool 32 is, as illustrated in FIGS. 1 and 2, constructed of a plurality of stationary bending beam tool segments 44 which are mounted on the bending beam 30 so as to be interchangeable. Each of these stationary bending beam tool segments 44 comprises a base part 46, with which this is seated on the bending beam 30, as well as a pressure bar 48 which is held stationary on the base part 46 and forms at its end a pressure surface segment 50 likewise stationary relative to the base part 46, wherein the pressure surface segments 50 contribute to the formation of a combined bending beam pressure surface 52 of the bending beam tool 32.

In addition to the stationary bending beam tool segments 44, additional bending beam tool segments 54 are provided on the bending beam 30 which are mounted so as to be interchangeable but are adjustable and which likewise comprise a base part 56 and a pressure bar 58 which bears at its end a pressure surface segment 60 movable relative to the base part 56. Depending on the setting of the adjustable bending beam tool segment 54, the movable pressure surface segments 60 contribute to the formation of the pressure surface 52 of the bending beam tool 32 or not, wherein the bending beam tool 32 is composed of the sum of the stationary bending beam tool segments 44 and the adjustable bending beam tool segments 54. In this respect, the bending beam tool segments 54 are preferably arranged laterally of a stationary bending beam tool section 62 which is made up of all the stationary bending beam tool segments 44. The adjustable bending beam tool segments 54 serve in this case, first of all, to bend over the edge regions 20*b* in their active position, wherein the stationary bending beam tool section 62 is, in this case, taken along without any bending task, and subsequently in their inactive position to bend over the edge region 20*a*, which is located between lateral edge regions 20*b* of the workpiece 20, without touching the lateral edge regions 20*b* of the workpiece 20 and without needing to disassemble the bending beam tool segments 54.

In order to bend over the edge regions 20*b*, the adjustable bending beam tool segments 54 are arranged such that their movable pressure surface segments 60 act on the outer edge regions 20*b* of the workpiece when the bending beam 30 is pivoted about the pivot axis 16 and—as illustrated in the embodiment—bend over these outer edge regions 20*b* of the workpiece 20 whereas the edge region 20*a* is not located in the area of operation of the bending beam tool 32 due to the fact that it is, for example, set back in relation to the edge regions 20*b*. For this purpose, the movable pressure surface segment 60 is, as illustrated in FIG. 3, located in its active position, in which it acts on the edge region 20*b* during the pivoting of the bending beam 30 about the pivot axis 16.

Figure 4:
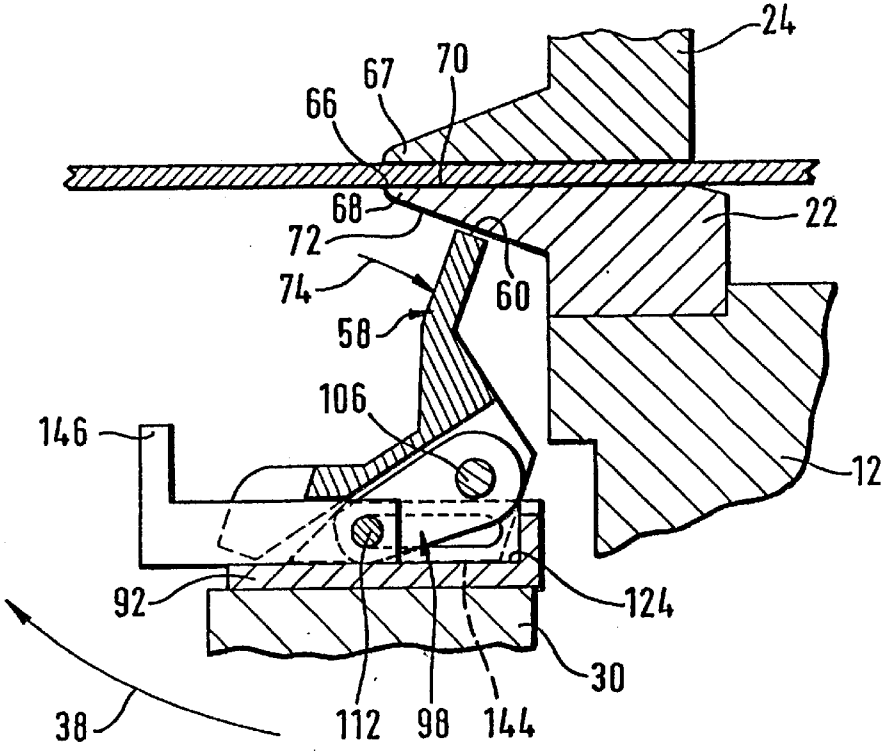
FIG. 4 shows a cross section similar to FIG. 3 with an adjustable bending beam tool segment in an inactive position.

The movable pressure surface segment 60 can, as illustrated in FIG. 4, be brought into an inactive position, in which this does not act on a workpiece 20 clamped between the lower beam tool 22 and the upper beam tool 24. For this purpose, the movable pressure surface segment 60 can preferably be brought out of its active position, in which this is immediately adjacent to a workpiece plane 64 and located laterally next to a lower beam tool tip 68 defining a bending edge 66 together with an upper beam tool tip 67, into an inactive position, in which the movable pressure surface segment 60 is located so as to face a lower side 72 of the lower beam tool tip 68 facing away from a clamping surface 70 of the lower beam tool tip 68 and thus is arranged so as to be offset relative to the bending edge 66 in a direction 74 contrary to the bending pivot direction 38.

Figure 3:
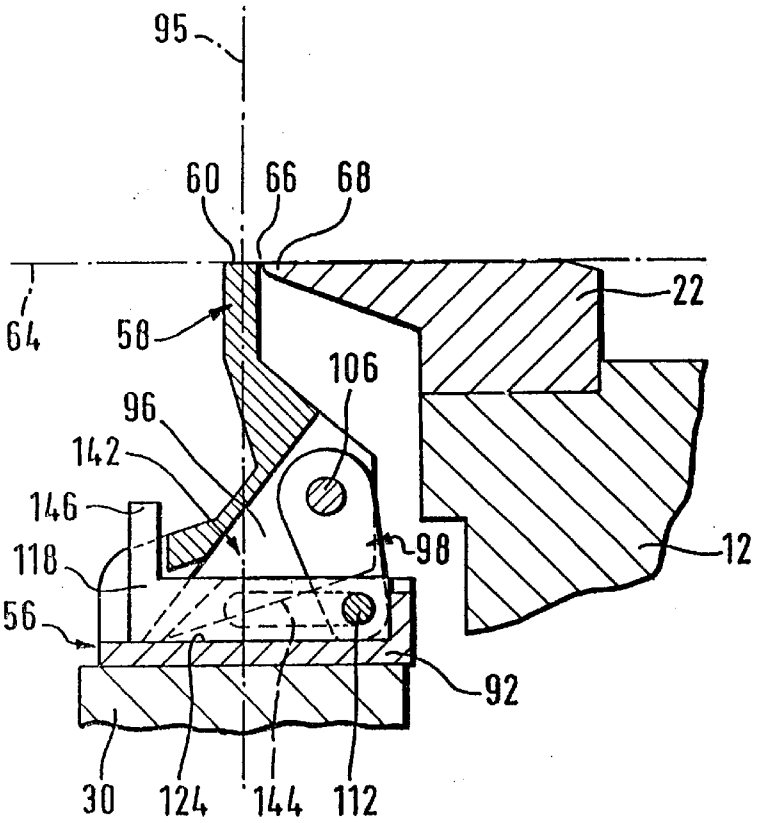
FIG. 3 shows a cross section through a lower beam tool and an adjustable bending beam tool segment of the first embodiment in its active position.
Figure 5:
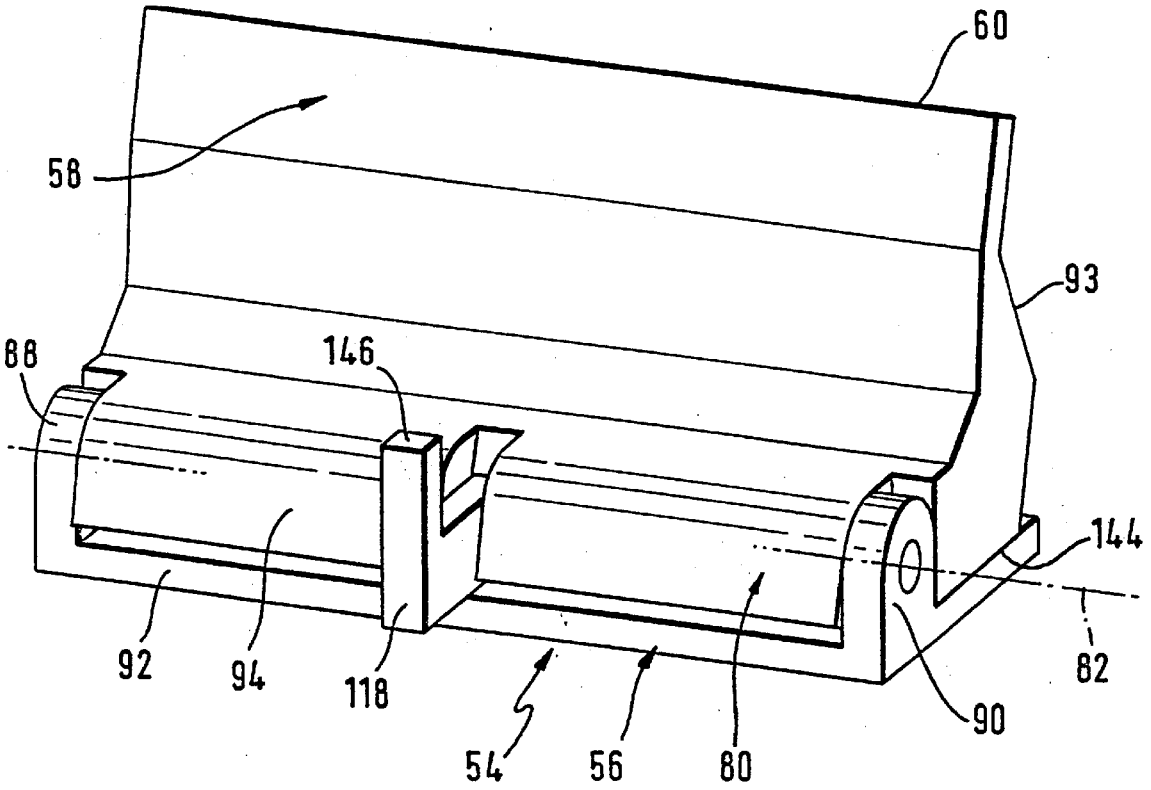
FIG. 5 shows a perspective illustration of a bending beam tool segment of the first embodiment adjustable in accordance with the invention.
Figure 6:
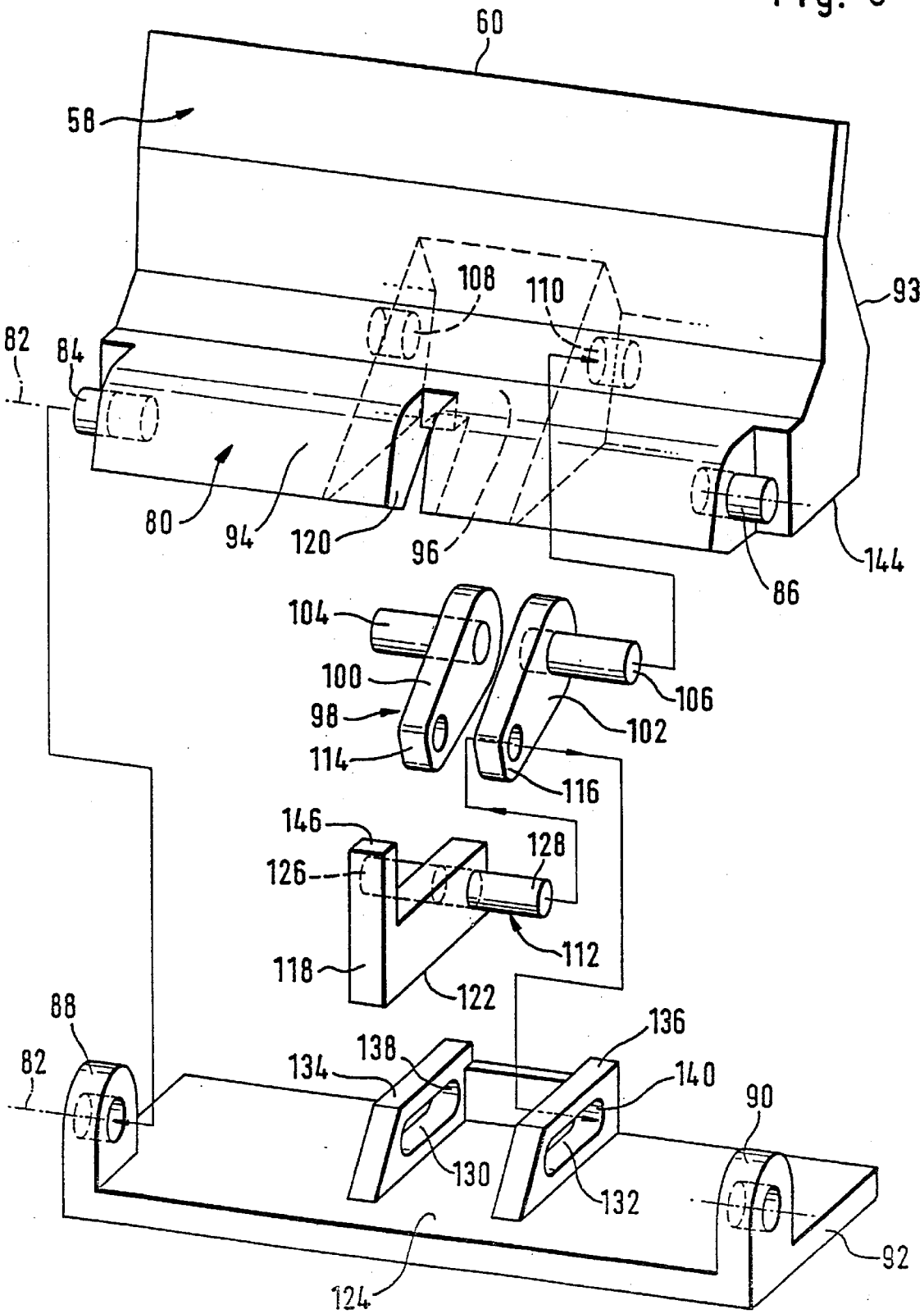
FIG. 6 shows an exploded illustration of the bending beam tool segment according to FIG. 5.

In order to be able to move the pressure surface segment 60 from the active position, illustrated in FIG. 3, into the inactive position, illustrated in FIG. 4, the adjustable bending beam tool segment 54 comprises, as illustrated on an enlarged scale in FIG. 5 and FIG. 6, a bearing member 80 which is integrally formed on the pressure bar 58 and at the two opposite sides of which two bearing pins 84, 86 are accommodated, which are arranged coaxially to an axis of movement 82. The bearing pins 84, 86 thereby engage in bearing flanges 88, 90 of the base part 56 which project from a base plate 92 of the base part 56 upwards in the direction of the bearing member 80. The axis of movement 82 is thereby located on a side 94 of the bearing member 80 pointing in bending pivot direction 38 whereas the pressure bar 58 is integrally formed onto a region 93 of the bearing member 80 located opposite the side 94 and is elevated from this. The axis of movement 82 is thus arranged so as to be offset in the direction of the bending pivot direction 38 in relation to a mid-vertical 95 of the pressure surface segment 60.

Furthermore, the bearing member 80 has a cutout 96 located approximately in the center, in which a support arm 98 is arranged which comprises two levers 100, 102 which are located next to one another and each of which is mounted by means of a bearing pin 104, 106 so as to be pivotable in a corresponding recess 108, 110 in the bearing member 80, wherein the recesses 108 and 110 extend into the bearing member 80 on both sides of the cutout 96.

Proceeding from the bearing pins 104, 106 forming the pivot bearings, the two levers 100, 102 extend towards a common slide pin 112 and are likewise mounted on this with their end regions 114 and 116, respectively, located opposite the respective bearing pins 104 and 106 so as to be rotatable. The slide pin 112 is thereby seated on a slide 118 which is preferably located centrally between the two levers 100, 102 so that the slide pin 112 extends through the slide 118 and on both sides thereof for mounting the end regions 114, 116 of the levers 100, 102.

The slide 118 is thereby guided in a guide slot 120 of the bearing member 80, wherein the guide slot 120 extends through the bearing body 80, proceeding from the side 94, and ends in the cutout 96. Furthermore, the slide 118 is guided so as to rest with its underside 122 on an upper side 124 of the base plate 92.

The slide pin 112 extends from the slide 118 through the levers 100, 102 and beyond these and is guided with its respective outer ends 126, 128 in elongated holes 130, 132 which form longitudinal guide means for these and are arranged in flange plates 134, 136 rising from the base plate 92 and securely connected to it.

The elongated holes 130 and 132 preferably extend parallel to the upper side 124 of the base plate 92 and define, as illustrated in FIG. 3 and FIG. 4, end positions of the slide bolt 112 which correspond to the active and inactive positions of the movable pressure surface segment 60.

In the end position illustrated in FIG. 3, the slide pin 112 abuts on an end 138, 140 of the elongated holes 130, 132 remote from the axis of movement 82, wherein in this position the support arm 98 holds the bearing member 80 pivoted around the axis of movement 82 to such an extent that the pressure surface segment 60 is in its active position. This active position of the bearing member 80 is supported on the base plate 92 via the support arm 98, the slide pin 112 as well as the flange plates 134, 136. This position is stable due to the fact that the support arm 98 forms together with a region 142 of the bearing member 80 extending between the bearing pins 104, 106 and the axis of movement 82 an elbow lever mechanism which remains stable due to the fact that the projection of the position of the bearing pins 104, 106 onto a connecting line between the slide pin 112 and the axis of movement 82 is located between these, wherein the function of the elbow lever mechanism presupposes that the axis of movement 82 as well as the bearing pins 104, 106 and the slide pin 112 are aligned parallel to one another in all positions.

The support arm 98 can, in addition, be moved from its supporting position illustrated in FIG. 3 into a non-supporting position illustrated in FIG. 4, in which the slide pin 112 is located in a region of the elongated holes 130, 132 located next to the axis of movement 82. In this case, the entire bearing member 80 tilts about the axis of movement 82 in such a manner that the pressure bar 58 is lowered in the direction towards the base plate 92.

As a result, the movable pressure surface segment 60 is moved away from the bending edge 66 in the direction 74 and at the same time lowered in the direction of the bending beam 30 so that the movable pressure surface segment 60, in its inactive position, faces the lower side 72 of the lower beam tool tip 68. In this non-supporting position of the support arm 98, illustrated in FIG. 4, the bearing member 80 finally abuts with its underside 144 on the upper side 124 of the base plate 92.

In order to move the support arm 98 from its non-supporting position into the supporting position and vice versa, the slide 118 is provided which acts on the slide pin 112 and with which the slide pin 112 can be displaced in the elongated holes 130 and 132.

The slide 118 can, in principle, be actuated manually. It is, however, particularly advantageous when the slide 118 has a slide nose 146 which points upwards away from the base plate 92 and facilitates actuation of the slide 118.

In order to be able to actuate the slide 118 via a machine control 148, a manipulator designated as a whole as 150 is, as illustrated in FIG. 1, arranged on the upper beam 14 and is movable in a transverse direction 152 essentially over the entire width of the upper beam 14 and along it. For this purpose, the manipulator 150 is guided in a manipulator guide means 154 on the upper beam 14 and can be positioned in a defined manner at any optional location in the transverse direction 152 by means of an adjusting spindle 158 drivable by a spindle drive 156. In this respect, the spindle drive 156 is controlled via the machine control 148 in the manner of a numerically controlled axis.

The manipulator 150 is, for its part, provided with an actuating arm 160 which can be pivoted about an axis 162 by means of a drive which is not illustrated so that the slide nose 146 can be actuated by an end 164 of the actuating arm 160.

Figures 7, 7A, 7B, 7C, 7D, 7E:
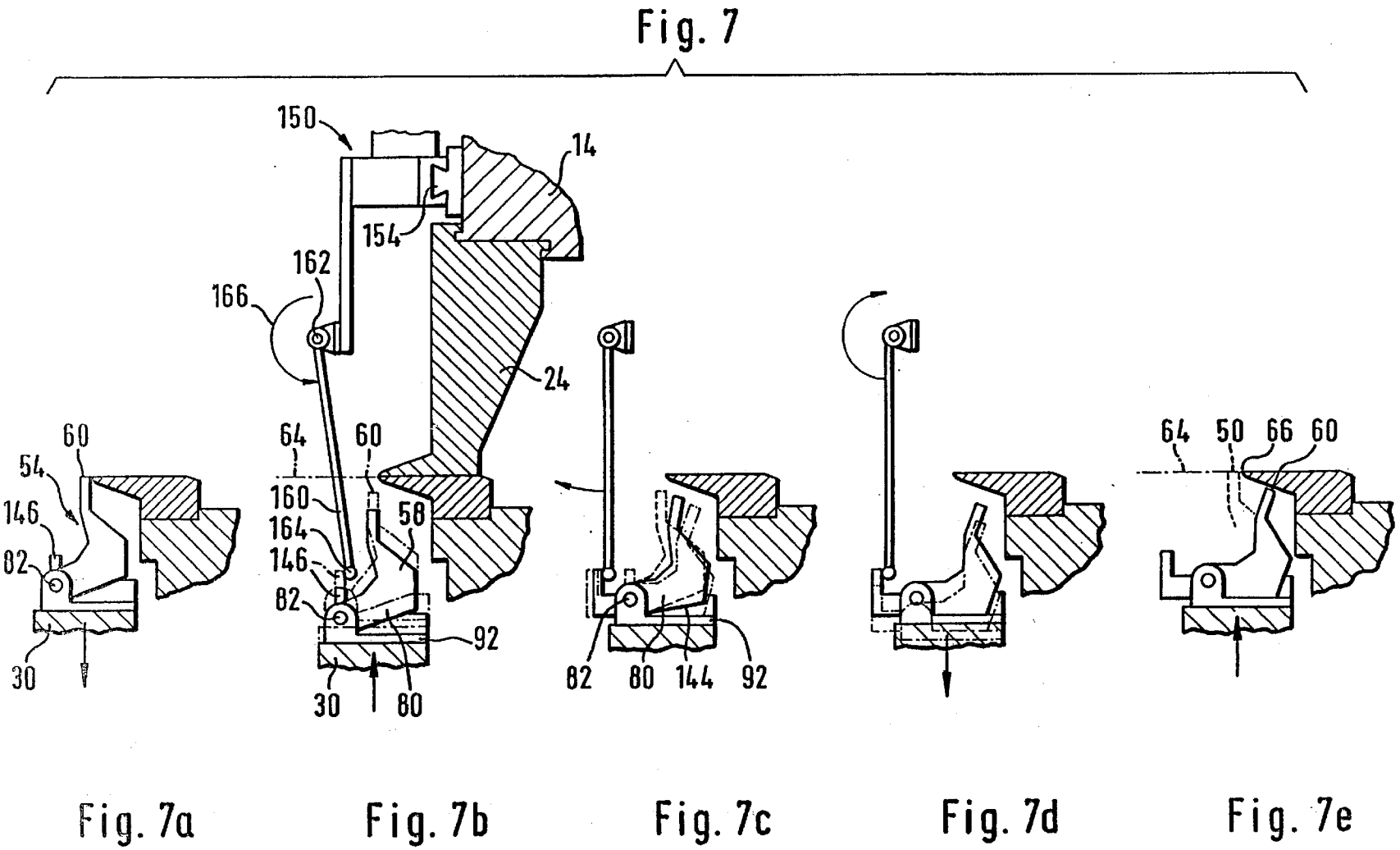
FIGS. 7*a*–7*e* show a section similar to FIG. 3 with illustration of a transfer of the adjustable bending beam tool segment from the active position according to FIG. 7*a* into the inactive position according to FIG. 7*e;*

As illustrated in FIGS. 7*a* to 7*e*, it is possible, proceeding from the active position of the movable pressure surface segment 60 illustrated in FIG. 7*a*, to engage behind the slide nose 146 of the slide 118 with the end 164 of the actuating arm 160, wherein the actuating arm 160 is to be pivoted in the direction 166 towards the slide nose 146 and engagement behind the slide nose 146 is possible due to the fact that the bending beam 30 is lowered in a direction 40, proceeding from the position illustrated in FIG. 7*a*, to such an extent away from the pivot axis 36 that the end 164 of the actuating arm 160 can be positioned between the slide nose 146 and the pressure bar 58 of the bending beam tool segment 54 and, subsequently, the bending beam 30 must again be raised to such an extent that the end 164 is in a position to act on the slide nose 146. In the raised position, the bending beam 30 is, however, as illustrated in FIG. 7*b* by dash-dot lines, located such that the pressure surface segment 60 is spaced from the workpiece plane 64. The movement of the bending beam 30 in a direction 40 and contrary thereto is thereby carried out via the adjusting drive 42 illustrated schematically in FIG. 1, controlled by the machine control 148.

In the position of the bending beam 30 illustrated in FIG. 7*b* by dash-dot lines, the bearing member 80 can now be pivoted from the active position into the inactive position due to movement of the slide nose 146 away from the bearing member 80, wherein the slide pin 112 migrates away from the ends 138 and 140, respectively, of the elongated holes 130, 132 into a position close to the axis of movement 82 so that—as already described—the entire bearing member 80 tilts about the axis of movement 82 and, finally, comes to rest with its underside 144 on the upper side 124 of the base plate 92.

Subsequently, as illustrated in FIG. 7*d*, the bending beam 30 is again lowered by means of the adjusting drive 42 in order to bring the end 164 of the actuating arm 160 out of engagement with the slide nose 146. Thereafter, as illustrated in FIG. 7*e*, the bending beam 30 is raised to such an extent that the pressure surface segments 50 of the stationary bending beam tool segments 44 are again located directly next to the bending edge 66 and adjacent to the workpiece plane 64 in order to be able to carry out bending of the edge region 20*a* with these, as illustrated on an enlarged scale in FIG. 8.

Figure 8:
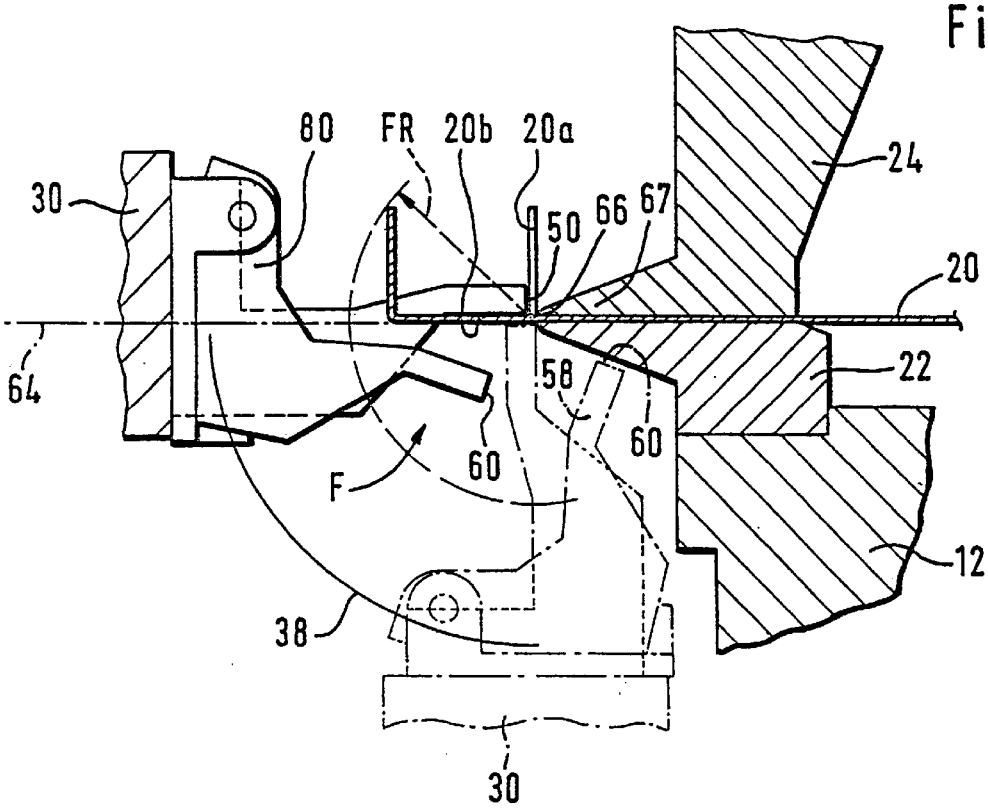
FIG. 8 shows a section similar to FIG. 3 through the lower beam tool, the upper beam tool and an adjustable bending beam tool segment in inactive position during the course of a bending operation.

The pressure surface segment 60 located in the inactive position is displaced in relation to the bending edge 66 to such an extent in the direction 74 that, proceeding from the bending start position illustrated in FIG. 8 by dash-dot lines, the pressure surface segment 30 can have no contact at all with the edge region 20*b* during the entire bending operation with movement of the bending beam 30 in the bending pivot direction. Furthermore, the pressure bar 58 in the inactive position is also located such that this can also not come into contact at all with the edge region 20*b* of the workpiece 20. The pressure bar 58 is preferably always located on one side of the workpiece plane 64 without moving through this and so no collision whatsoever with the edge region 20*b* can occur, irrespective of the length thereof. The length of the possible edge region 20*b* is merely determined by the distance, by which the bearing member 80 is located from the bending edge 66 in the bending end position illustrated in FIG. 8 by solid lines since part of the bearing member 80 moves through the workpiece plane 64 during the movement of the bending beam 30 in the bending pivot direction 38.

Collisions with the edge region 20*b* are always avoided when all the regions of the bending beam tool segment 54 passing through the workpiece plane 64 during the bending operation are located outside a free space F defined by a free space radius FR around the bending edge 66.

Figures 9, 9A, 9B, 9C, 9D:
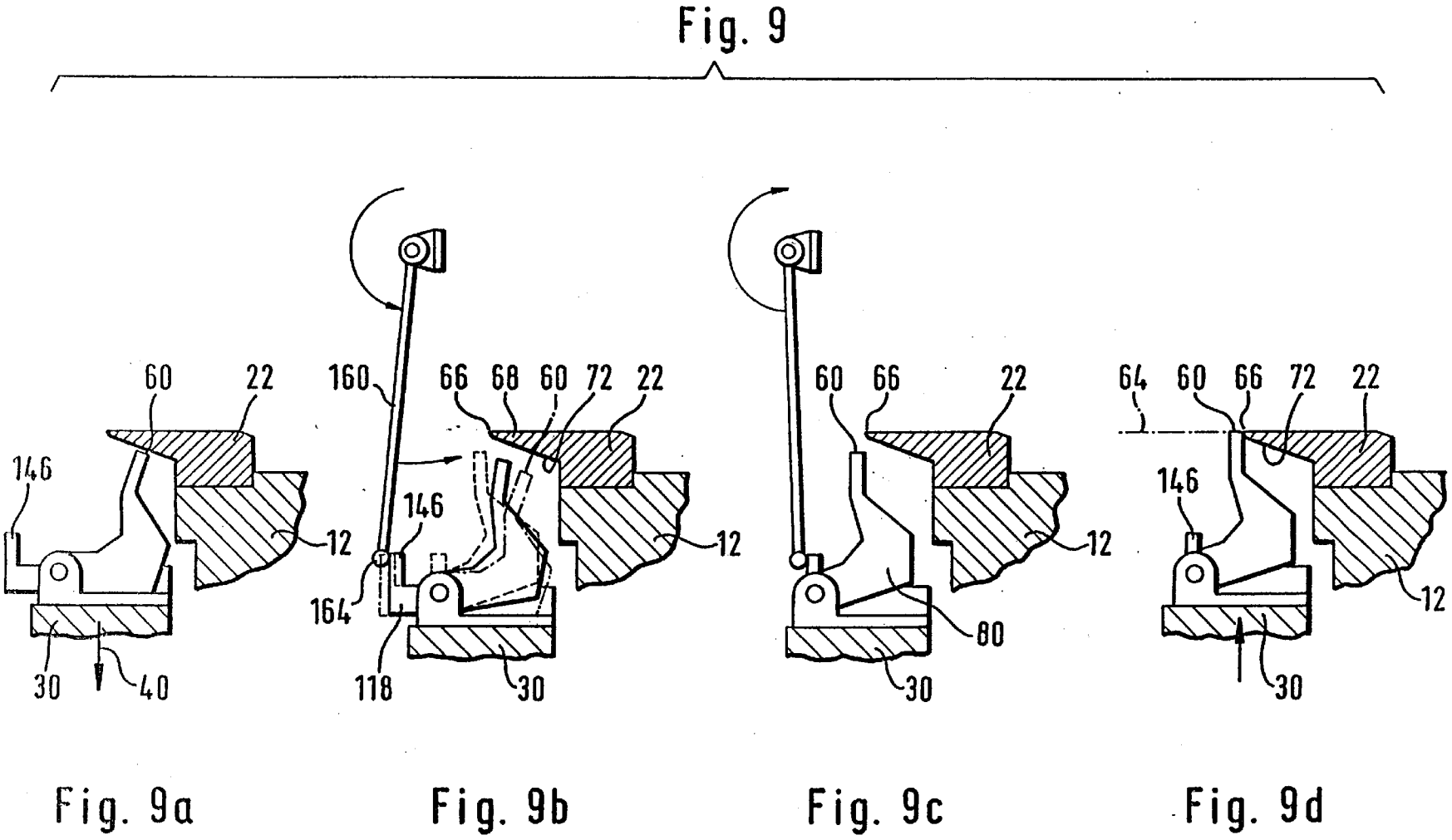

Transfer of the movable pressure surface segment 60 from the inactive position into the active position is illustrated in FIG. 9. As illustrated in FIG. 9*a*, the bending beam 30 is moved first of all by the machine control 148 in a direction 40 away from the pivot axis 36, proceeding from the inactive position of the pressure surface segment 60, by means of the adjusting drive 42 so that the pressure surface segment 60 is spaced from the underside 72 of the lower beam tool tip 68.

In this position, the slide 118 is now displaced by means of the end 164 such that the support arm 98 is transferred from the non-supporting position, illustrated in FIG. 4, into the supporting position, illustrated in FIG. 3, and thus the bearing member 80 is tilted to such an extent until the pressure surface segment 60 is in its active position, as illustrated in FIG. 9*c*. Subsequently, the bending beam 30 is again moved contrary to the direction 40 to such an extent in the direction of the pivot axis 36 that the pressure surface segment 60 is again directly adjacent to the workpiece plane 64 and located next to the bending edge 66, as illustrated in FIG. 9*d*.

Figure 10:
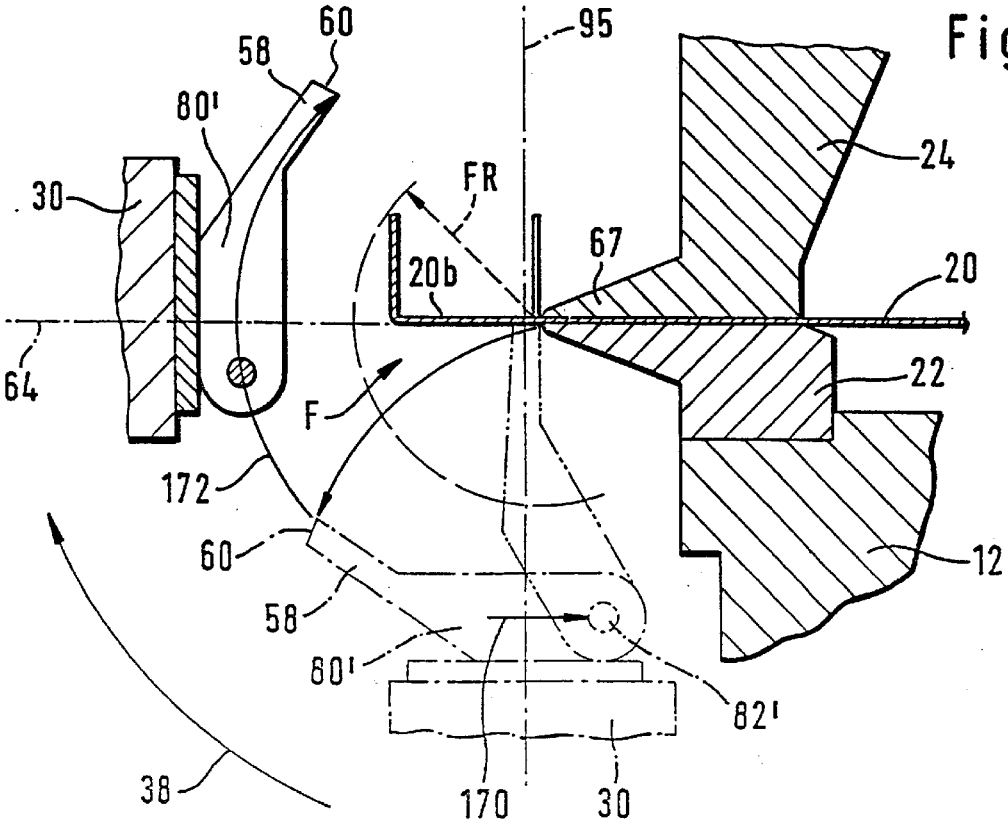
FIGS. 9*a*–9*d* show an illustration similar to FIG. 4 with illustration of a transfer of the adjustable bending beam tool segment from the inactive position according to FIG. 9*a* into the active position according to FIG. 9*d* and FIG. 10 shows a section similar to FIG. 8 through a second embodiment of an inventive bending machine, wherein the bending beam tool segment is illustrated not only in the bending start position but also in the bending end position.

In a second embodiment of an inventive solution, illustrated in FIG. 10, the pressure bar 58 is seated with the pressure surface segment 60 on a bearing member 80' which is pivotable about an axis of movement 82' arranged in relation to the mid-vertical 95 so as to be offset in relation to the pressure surface segment 60 in a direction 170 contrary to the bending pivot direction 38. In this embodiment, the pressure surface segment 60 is moved from the active position (illustrated in FIG. 10 by dash-dot lines) into the inactive position (illustrated in FIG. 10 by solid lines) by a movement in the direction of the bending pivot direction 38.

In this inactive position, the pressure surface segment 60 moves along a circular path 172 around the edge region 20*b* without colliding with it.

In addition to the pressure surface segment 60, the other regions of the bending beam tool segment 54 are also located in the inactive position outside a free space radius FR around the bending edge 66 defining a free space F, insofar as they pass through the workpiece plane 64 during the bending operation.

What is claimed is:

1. A bending machine, comprising:

a lower beam with a lower beam tool and an upper beam with an upper beam tool, said upper beam tool and lower beam tool being moveable relative to one another for clamping a workpiece, a bending beam pivotable about a pivot axis and having a bending beam tool arranged on it, said bending beam tool comprising a series of bending beam tool segments, each of said bending beam tool segments having a pressure surface segment, wherein:

the pressure surface segments are adaptable to provide a bending beam pressure surface acting on the workpiece during bending, the bending beam tool segments include at least one adjustable bending beam tool segment, the pressure surface segment of the at least one adjustable bending beam tool segment is adapted to be moved from an active position, wherein it contributes to the pressure surface of the bending beam tool, into an inactive position, wherein it is without effect during a bending operation, and the moveable pressure surface segment is arranged in the inactive position so as to be offset in a direction towards the bending beam in relation to the active position, and located between the bending beam and the active position.

2. A bending machineas defined in claim 1, wherein the pressure surface segment in the inactive position is located in a bending start position on a side of a lower beam tool tip of the lower beam tool facing away from the upper beam tool.

3. A bending machine, comprising:

a lower beam with a lower beam tool and an upper beam with an upper beam tool, said upper beam tool and lower beam tool being moveable relative to one another for clamping a workpiece, and a bending beam pivotable about a pivot axis and having bending beam tool segments arranged on it, each of said tool segments having a pressure surface segment, wherein:

the pressure surface segments are adaptable to provide a bending beam pressure surface acting on the workpiece during bending, at least one bending beam tool segment is adjustable, the pressure surface segment of the at least one adjustable bending beam tool segment is adapted to be moved from an active position, wherein it contributes to the pressure surface of the bending beam tool, into an inactive position, wherein it is without effect during a bending operation, the bending beam tool segment has a base part and a pressure bar, said pressure bar is supported by said base part, said pressure bar bears the movable pressure surface segment, and said pressure bar is movable in relation to the base part.

4. A bending machine as defined in claim 3, wherein in the inactive position of the movable pressure surface segment, the pressure bar moves during the course of a bending operation free of contact in relation to a workpiece plane.

5. A bending machine as defined in claim 3, wherein in the inactive position of the movable pressure surface segment, the pressure bar remains on one side of the workpiece plane during the bending operation.

6. A bending machine as defined in claim 3, wherein the pressure bar is movable in a direction contrary to the bending pivot direction during the movement from the active into the inactive position.

7. A bending machine as defined in claim 3, wherein the pressure bar is located in bending end position on a side of the workpiece plane facing the bending start position.

8. A bending machine as defined in claim 3, wherein the pressure bar is pivotable back and forth between the active and the inactive position.

9. A bending machine as defined in claim 3, wherein the pressure bar is pivotable in relation to the base part about an axis parallel to the movable pressure surface segment and arranged on one side of a mid-vertical relative to the pressure surface segment.

10. A bending machine as defined in claim 9, wherein said axis is located on a leading side of the pressure bar in bending pivot direction.

11. A bending machine as defined in claim 3, wherein the pressure bar is adapted to be supported in the active position by a support arm pivotable back and forth between a supporting position and a non-supporting position.

12. A bending machine as defined in claim 11, wherein the support arm is guided with its free end in a slotted guide means determining the supporting and the non-supporting position.

13. A bending machine as defined in claim 11, wherein the support arm is actuatable by a slide.

14. A bending machine, comprising:

a lower beam with a lower beam tool and an upper beam with an upper beam tool, said upper beam tool and lower beam tool being moviable relative to one another for clamping a workpiece, and a bending beam pivotable about a pivot axis and having bending beam tool segments arranged on it, each of said tool segments having a pressure surface segment, wherein:

the pressure surface segments are adaptable to provide a bending beam pressure surface acting on the workpiece during bending, at least one bending beam tool segment is adjustable, the pressure surface segment of the at least one adjustable bending beam tool segment is adapted to be moved from an active position, wherein it contributes to the pressure surface of the bending beam tool, into an inactive position, wherein it is without effect during a bending operation, and the adjustable bending beam tool segment is actuable by a manipulator controllable by a machine control of the bending machine.

15. A bending machine as defined in claim 14, wherein the manipulator is displaceable parallel to the bending beam.

16. A bending machine as defined in claim 14, wherein the manipulator has an actuating arm for adjusting the adjustable bending beam tool segment.

17. A bending machine as defined in claim 16, wherein the actuating arm interacts with the slide of the adjustable bending beam tool segment for adjusting the same.

18. A bending machine, comprising:

a lower beam with a lower beam tool and upper beam with an upper beam tool, said upper beam tool and lower beam tool being moveable relative to one another for clamping a workpiece a bending beam pivotable about a pivot axis and having a bending beam tool arranged an it, said bending beam tool comprising a series of bending beam tool segments arranged on it, each of said bending beam tool segments having a pressure surface segment, wherein:

the pressure surface segments are adaptable to provide a bending beam pressure surface acting on the workpiece during bending, the bending beam tool segments include at least one adjustable bending beam tool segment, the at least one adjustable bending beam tool segment is adapted to be arranged in a fixed position along said pivot axis that is fixed with respect to the positions of other ones of said bending beam tool segments, and in said fixed position, the pressure surface segment of the at least one adjustable bending beam tool segment is adapted to be moved from an active position, wherein it contributes to the pressure surface of the bending beam tool, into an inactive position, wherein it is without effect during a bending operation.

* * * * *